US006015199A

United States Patent [19]

Netzer et al.

[11] Patent Number: 6,015,199

[45] Date of Patent: Jan. 18, 2000

[54] GUIDE RAIL ASSEMBLY FOR DRAWERS

[75] Inventors: Emanuel Netzer, Höchst; Günter Öhy, Hohenems, both of Austria

[73] Assignee: Julius Blum Gesellschaft M.B.H., Höchst, Austria

[21] Appl. No.: 09/053,085

[22] Filed: Apr. 1, 1998

[30] Foreign Application Priority Data

Apr. 1, 1997 [AT] Austria ..... 544/97

[51] Int. Cl.[7] ..... A47B 88/00

[52] U.S. Cl. ..... 312/334.8; 312/334.46; 312/334.9

[58] Field of Search ..... 312/334.6, 334.7, 312/334.8, 334.9, 334.12, 334.13, 334.14, 334.15, 334.44, 334.46

[56] References Cited

U.S. PATENT DOCUMENTS

| | | | |
|---|---|---|---|
| 5,181,781 | 1/1993 | Wojcik | 312/334.44 X |
| 5,564,807 | 10/1996 | Rock et al. | 312/334.6 X |
| 5,769,518 | 6/1998 | Grabher | 312/334.12 X |
| 5,775,787 | 7/1998 | Gasser | 312/334.12 |

FOREIGN PATENT DOCUMENTS

| | | |
|---|---|---|
| 375 252 | 7/1984 | Austria . |
| 0 355 914 | 2/1990 | European Pat. Off. . |
| 0 488 471 | 6/1992 | European Pat. Off. . |
| 0 743 031 | 11/1996 | European Pat. Off. . |

*Primary Examiner*—Janet M. Wilkens
*Assistant Examiner*—Karlena D. Schwing
*Attorney, Agent, or Firm*—Wenderoth, Lind & Ponack, L.L.P.

[57] ABSTRACT

A guide rail assembly for use on each of opposite sides of a drawer to guide movement of the drawer into and out of an article of furniture includes a supporting rail to be attached to a furniture side wall, a pull out rail to be attached to the drawer, and at least one carriage for load transmitting rollers situated between the supporting rail and the pull out rail. The pull out rail and the supporting rail are provided with stops for limiting movement of the pull out rail and the carriage with respect to the supporting rail. The carriage is provided with buffers, whereby the carriage and the buffers are made in one piece of plastic material. The buffers each have the form of a meander or serpentine shaped protrusion.

14 Claims, 8 Drawing Sheets

GUIDE RAIL ASSEMBLY FOR DRAWERS

FIELD AND BACKGROUND OF THE INVENTION

The invention relates to a guide rail assembly for use on each of opposite sides of a drawer to guide movement of the drawer into and out of an article of furniture, the assembly including a supporting rail to be attached to a furniture side wall, a pull out rail to be attached to the drawer, and at least one carriage for load transmitting rollers situated between the supporting rail and the pull out rail, the pull out rail and the supporting rail being provided with stops for limiting movement of the pull out rail and the carriage with respect to the supporting rail. When the drawer is moved with too much force such guide rail assemblies can be considered as too loud which is due to the noise that occurs when the carriages hit stops of the rails. This particularly is the case when an intermediate rail is provided between the supporting rail and the pull out rail.

SUMMARY OF THE INVENTION

It is the object of the invention to improve such a guide rail assembly in such a way that it provides smooth and silent running characteristics.

The object of the invention is obtained in that the carriage is provided with at least one buffer, the carriage and such buffer being made in one piece of plastic material and the buffer having the form of a meander or serpentine shaped protrusion.

Advantageously, an intermediate rail provided with stops is mounted between the supporting rail and the pull out rail, and a carriage with at least one first buffer is provided between the supporting rail and the intermediate rail and a further carriage with at least one second buffer is provided between the intermediate rail and the pull out rail. Further advantageously, two carriages with load transmitting rollers are situated between the intermediate rail and the pull out rail, one of such two carriages being provided with buffers.

To provide an improved lateral guidance for the intermediate rail, an embodiment of the invention provides that one carriage which is provided with buffers comprises two roller cages perpendicular to each other and connected by a web.

DESCRIPTION OF A PREFERRED EMBODIMENT

Figure 1:
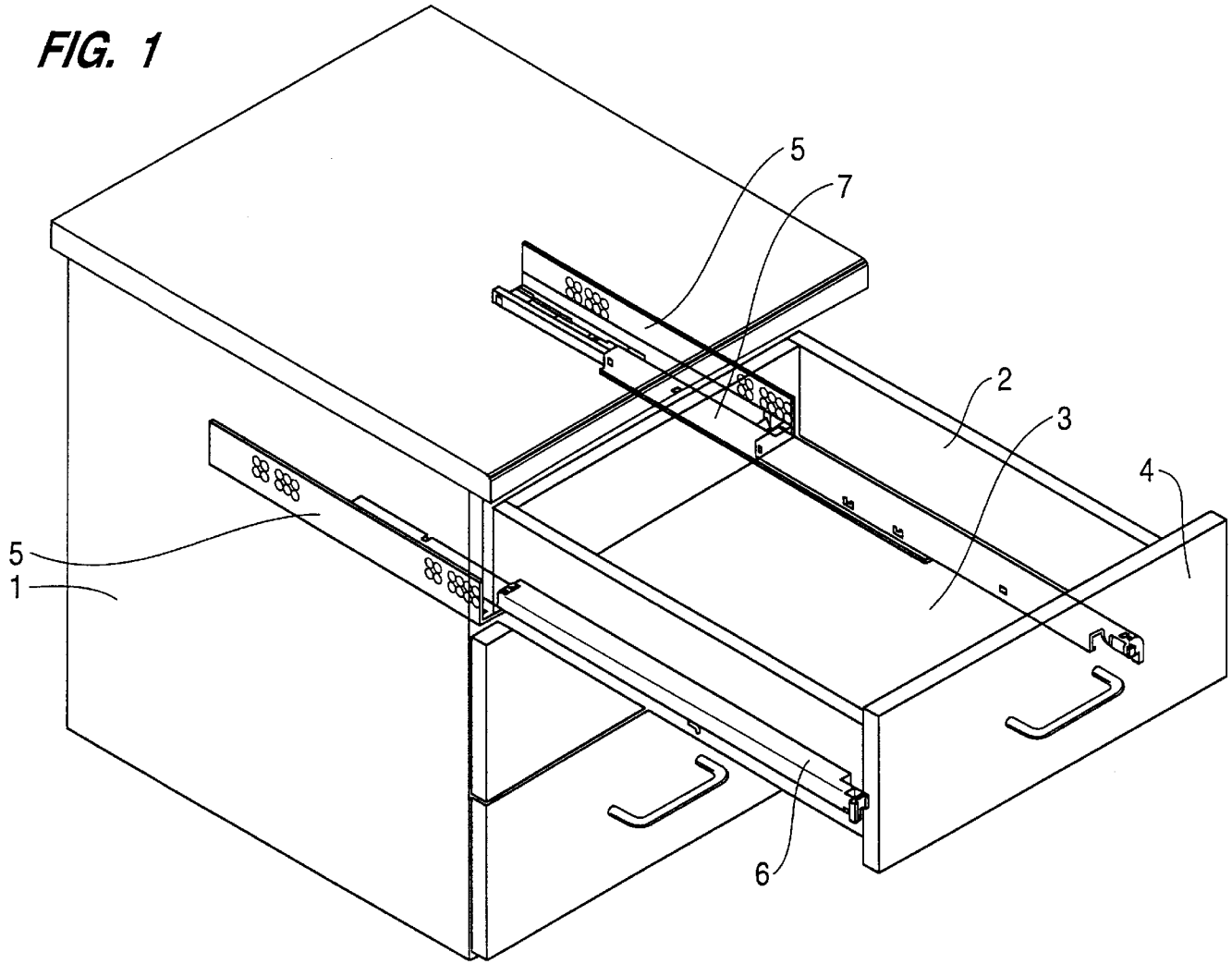
FIG. 1 is a perspective view of an article of furniture with drawers provided with guide rail assemblies according to the invention.
Figure 3:
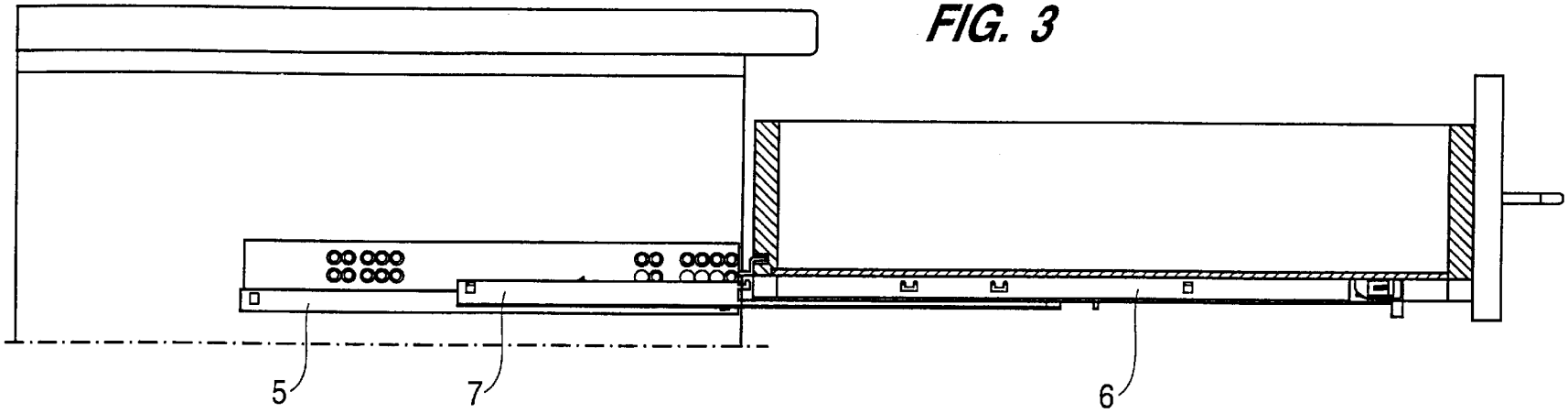
FIG. 3 is a side view of the guide rail assembly.
Figure 2:
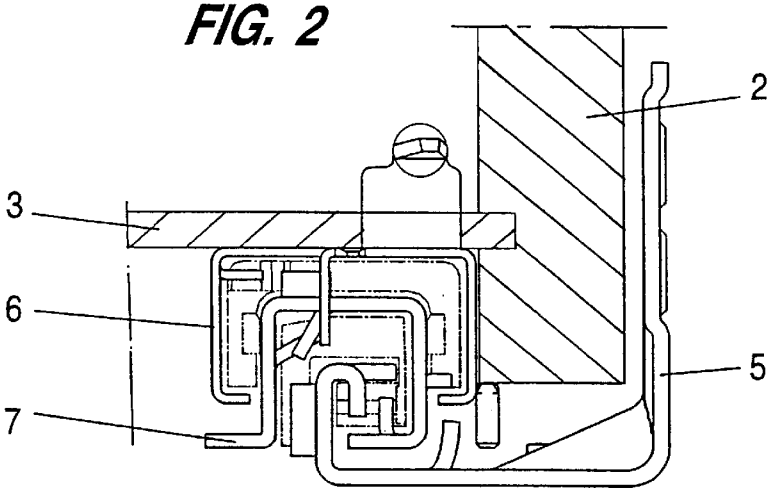
FIG. 2 is a front view of a furniture side wall and rails of the guide assembly at one side of the drawer.
Figure 4:
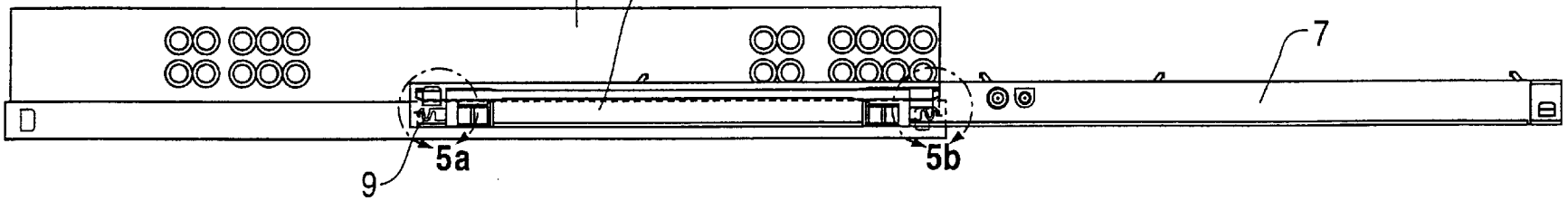
FIG. 4 is a side view of a supporting rail and an intermediate rail.

At each side of a drawer there are provided a supporting rail 5 which is fastened to a side wall 1 of an article of furniture, a pull out rail 6 fastened to the drawer and an intermediate rail 7. The guide rail assembly according to the invention can be mounted underneath bottom plate 3 of the drawer as well as within double walled drawer side walls made of plastic material or metal or be fastened to the side of a drawer side wall 2 made of wooden material as shown in FIG. 1.

Carriages 8, 11, 12, are situated between the rails 5, 6, 7.

Load transmitting rollers and lateral guiding rollers are provided in the carriages 8, 11, 12. The rollers are not shown in the drawings. With the carriage 8, load transmitting rollers are provided in a cage 15 and lateral guiding rollers in a cage 16. In the carriages 11, 12 the load transmitting rollers are provided in cages 17 and the lateral guiding rollers in cages 18.

Figure 5B:
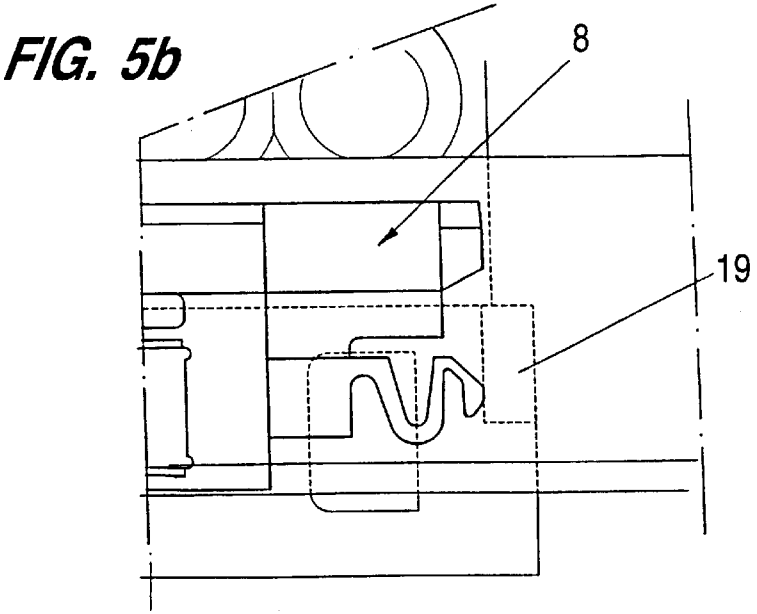
FIGS. 5*a* and 5*b* are side views of front and rear ends of a carriage at the beginning of buffering.
Figure 5A:
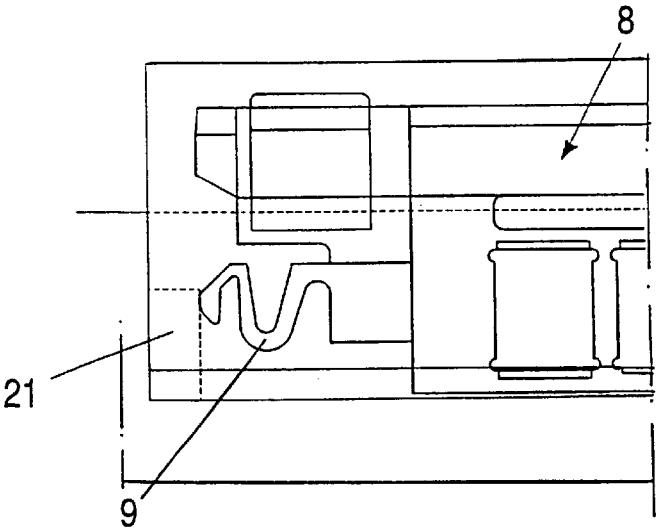
Figure 6:
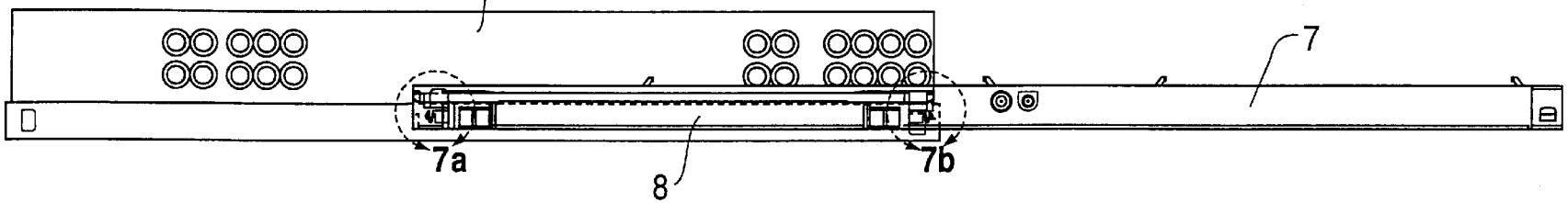
FIG. 6 is a side view of the supporting rail and the intermediate rail, the intermediate rail being in a foremost position thereof.
Figure 7B:
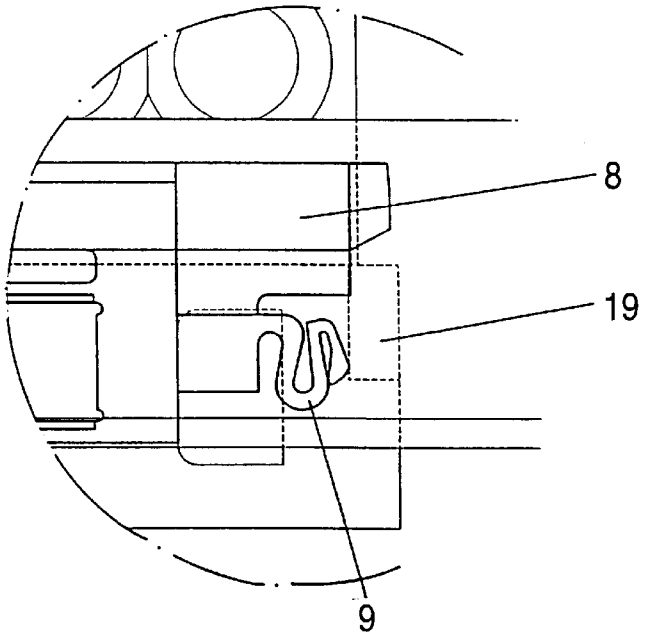
FIGS. 7*a* and 7*b* are side views of the front and rear ends of the carriage at the end of buffering.
Figure 7A:
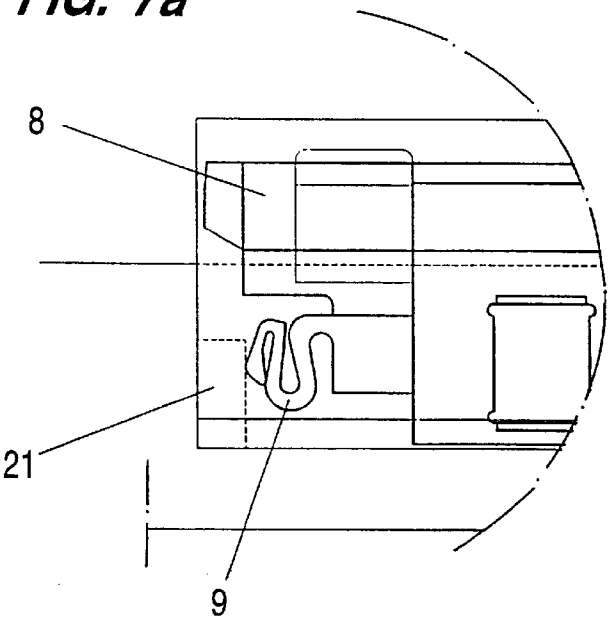
Figure 8:
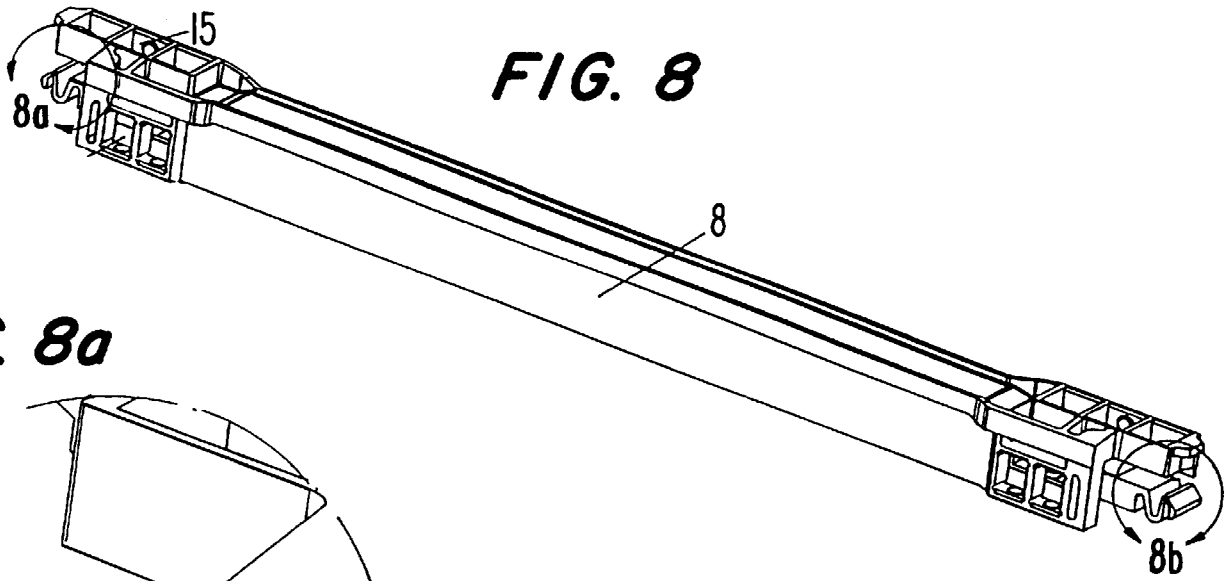
FIG. 8 is a perspective view of the carriage situated between the intermediate rail and the supporting rail.
Figure 8B:
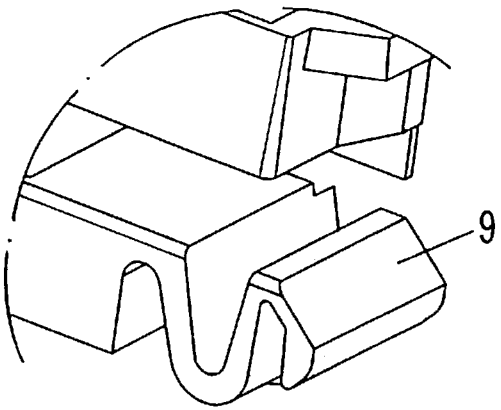
FIGS. 8*a* and 8*b* are perspective views of buffers.
Figure 8A:
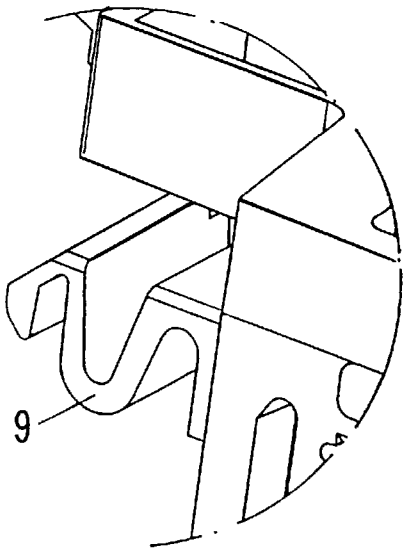
Figure 9:
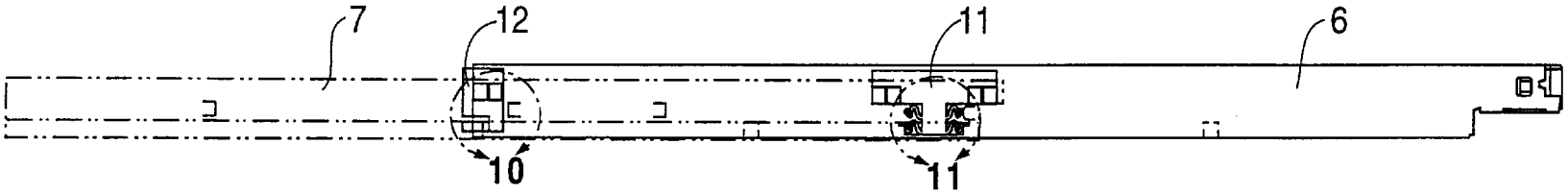
FIG. 9 is a plan view of a pull out rail and the intermediate rail in foremost position thereof.
Figure 11:
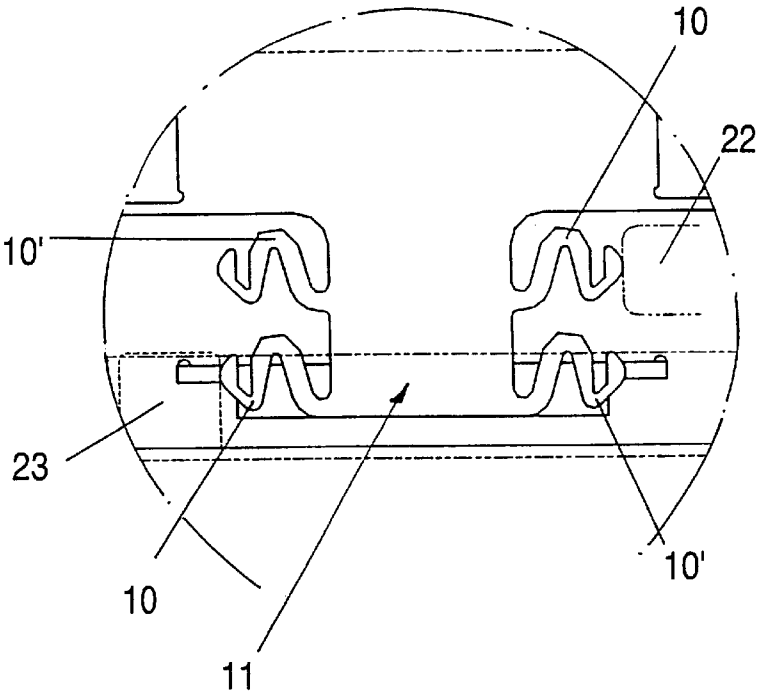
FIG. 11 is a plan view of a front carriage at the beginning of buffering.
Figure 10:
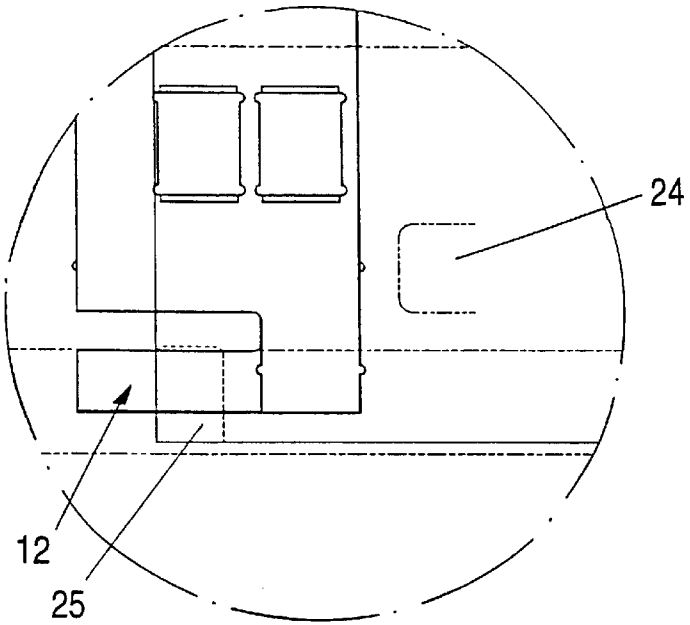
FIG. 10 is a plan view of a rear carriage.
Figure 12:
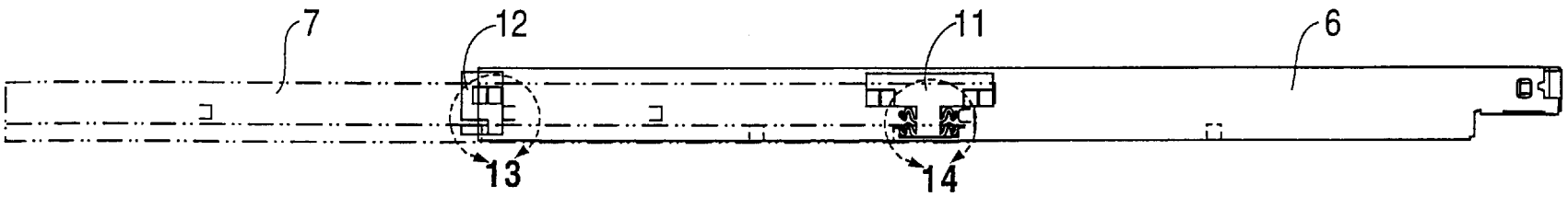
FIG. 12 is a plan view of the pull out rail and the intermediate rial in an extracted position.

The carriage 8 is situated between the supporting rail 5 and the intermediate rail 7, while the carriages 11, 12 are situated between the intermediate rail 7 and the pull out rail 6. The carriages 8, 11 are at their front and rear end walls provided with buffers 9, 10 which act as damping springs. The buffers 9, 10 are of serpentine or meander form and are constituted by two adjacent U-shaped members directed to opposite directions. The buffers 9, 10 are made of one piece together with respective carriages 8, 11 out of plastic material. In the embodiment shown the carriages 8, 11 with buffers 9, 10 were made by injection molding. The carriage 8 is provided with one buffer 9 at its front end and one at its rear end. The carriage 11 has two roller cages 13, 14 situated perpendicularly to each other and connected by a horizontal web 20. The buffers 10 are situated at front and rear faces of the web 20. If the drawer is pulled out of the article of furniture and reaches its foremost position, the front buffer 9 of the carriage 8 abuts a stop 19 of the supporting rail 5, while a stop 21 of the intermediate rail 7 presses onto the rear buffer 9 of the carriage 8. FIGS. 5*a* and *b* show the situation of the buffers 9 at the beginning of such buffering. When the intermediate rail 7 is moved further out of the article of furniture the buffers 9 are compressed between the stops 19, 21 as shown in FIGS. 7*a* and 7*b*. Contact between the supporting rail 5 and the intermediate rail 7 is therefore softer and not as loud as with guide rail assemblies according to the state of the art. Part of the kinetic energy of the guide rail assembly is absorbed by the buffers 9. When no pull out force acts on the drawer and on the intermediate rails 7, the buffers 9 expand to their original form.

Figure 14:
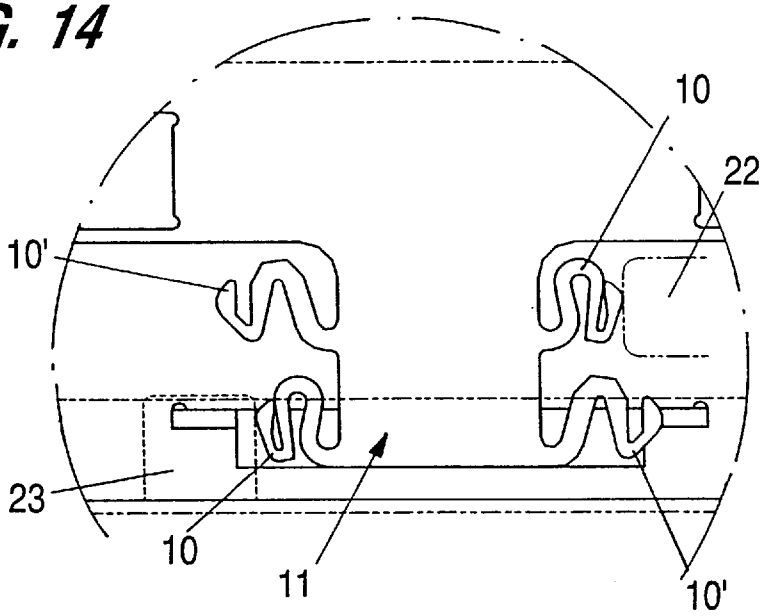
FIG. 14 is a plan view of the front carriage at the end of buffering.
Figure 13:
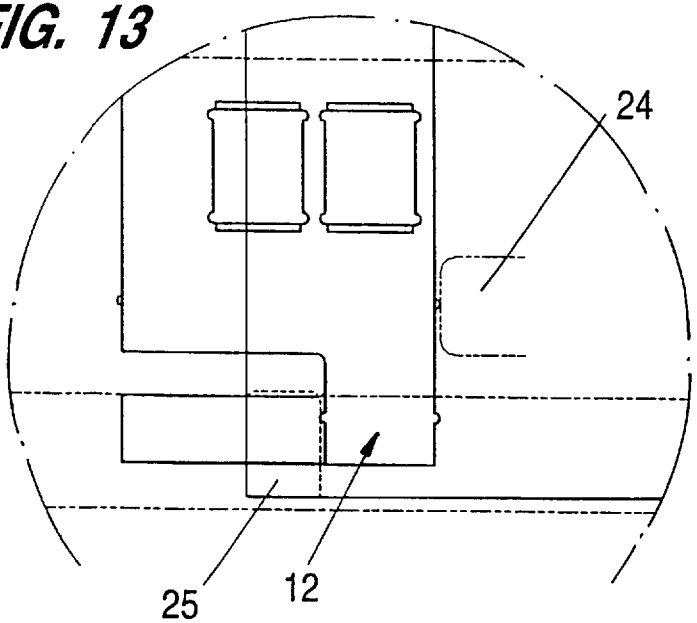
FIG. 13 is a plan view of the rear carriage.

In the foremost position of the drawer and therefore of the pull out rail 6 a front buffer 10 abuts a stop 22 of the intermediate rail 7 while a stop 23 of the pull out rail 6 presses on a rear buffer 10 which is diametrically opposed to the front buffer 10. The carriage 12 is situated between the two stops 24, 25 of the pull out rail 6 and the intermediate rail 7. When the drawer has been pulled out of the article of furniture forcefully the buffers 10 of the carriage 11 are compressed, as shown in FIG. 14, whereby part of the kinetic energy of the drawer is absorbed. In the absolute foremost position of the drawer the carriage 12 is clamped between stops 24, 25 of the pull out rail 6 and the intermediate rail 7, as shown in FIG. 13.

When the drawer is moved into the article of furniture, the buffers 9 of the carriage 8 are again compressed between the stops of the supporting rail 5 and the intermediate rail 7 when the drawer reaches its rearmost position. With the carriage 11 which is situated between the pull out rail 6 and the intermediate rail 7, shock absorbing or buffering is not effected by the buffers 10 but by buffers 10' which are situated adjacent to the buffers 10 and are also diametrically opposed to each other.

Figure 15:
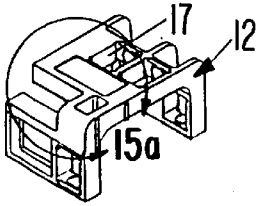
FIGS. 15 and 15*a* are perspective views of the rear carriage.
Figure 16:
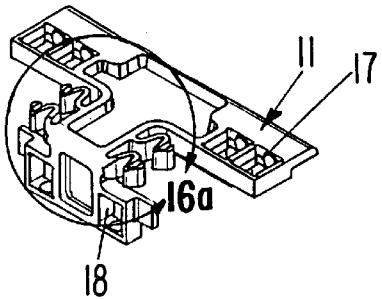
FIGS. 16 and 16*a* are perspective views of the front carriage.
Figure 15A:
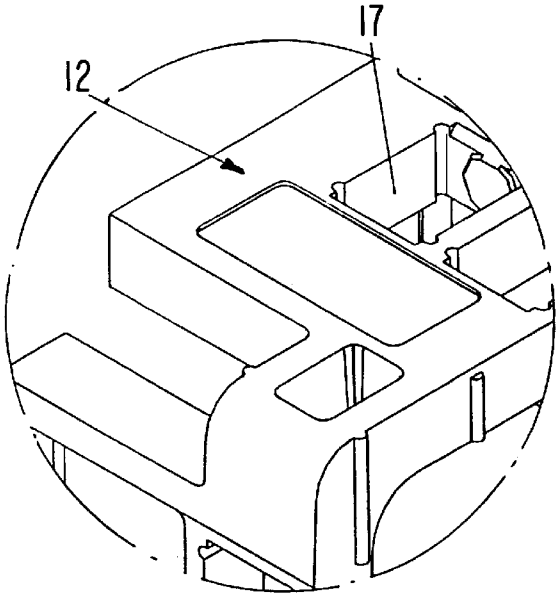
Figure 16A:
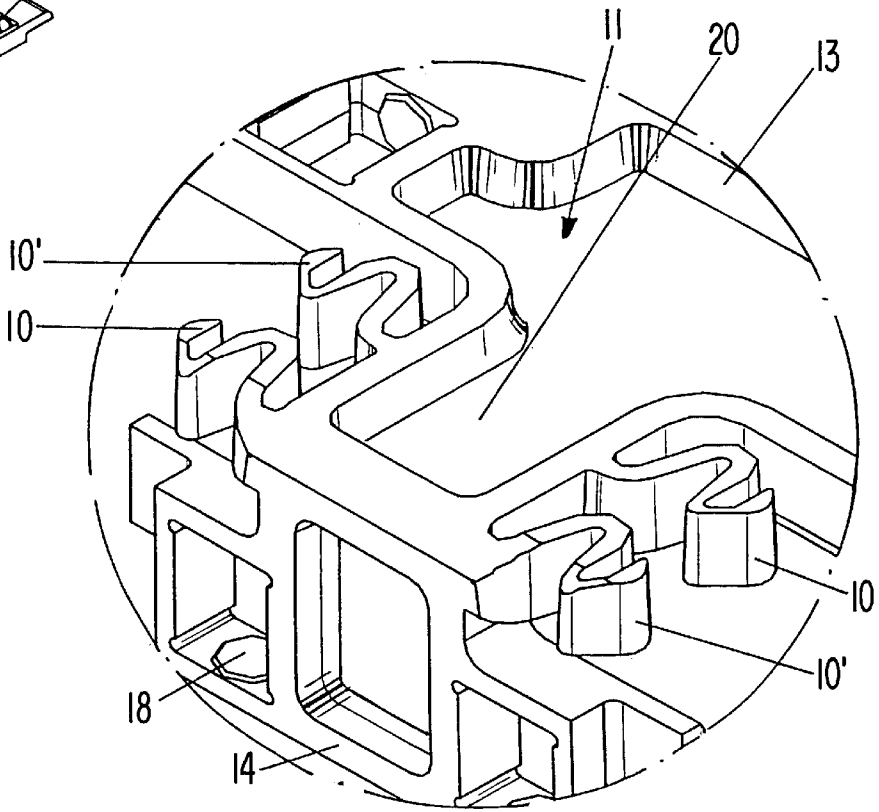

The carriage 12 as shown in FIG. 15 has a U-shaped configuration sand lateral guiding rollers are mounted in two vertical web of the carriage 12. In this way lateral stability of the guide rail assembly is improved.

We claim:

1. A guide rail assembly for use on each of opposite sides of a drawer to guide movement of the drawer into and out of an article of furniture, said assembly comprising:

a supporting rail to be mounted to a furniture side wall;

a pull out rail to be attached to the drawer;

at least one carriage situated between said supporting rail and said pull out rail;

said pull out rail and said supporting rail each having at least one stop for limiting movement of said pull out rail and said carriage with respect to said supporting rail;

said at least one carriage having at least one buffer to abut one of said stops, said at least one buffer being in the form of a serpentine-shaped protrusion; and said at least one carriage and said at least one buffer thereof being of unitary and one-piece construction of plastic material.

2. An assembly as claimed in claim 1, wherein said at least one carriage has at least one forwardly projecting buffer and at least one rearwardly projecting buffer.

3. An assembly as claimed in claim 1, wherein said at least one buffer is formed by two U-shapes facing in opposite directions.

4. An assembly as claimed in claim 1, further comprising an intermediate rail mounted between said supporting rail and said pull out rail, said intermediate rail having stops, and said at least one carriage comprises a first carriage provided between said supporting rail and said intermediate rail and a second carriage provided between said intermediate rail and said pull out rail, each of said first and second carriages having at least one said buffer.

5. An assembly as claimed in claim 4, further comprising a third carriage provided between said intermediate rail and said pull out rail.

6. An assembly as claimed in claim 5, wherein said third carriage is held between said stop of said intermediate rail and said stop of said pull out rail when said pull out rail is in a foremost position thereof.

7. An assembly as claimed in claim 6, wherein said third carriage is without buffers.

8. An assembly as claimed in claim 4, wherein said second carriage comprises two cages perpendicular to each other and connected by a web.

9. An assembly as claimed in claim 8, wherein said at least one buffer of said second carriage extends from said web.

10. An assembly as claimed in claim 9, wherein said second carriage has at least one buffer at a front of said web and at least one buffer at a rear of said web.

11. An assembly as claimed in claim 10, wherein said second carriage has two buffers at said front of said web and two buffers at said rear of said web.

12. An assembly as claimed in claim 11, wherein at front and rear final positions of said pull out rail one of said buffers at said front of said web and one of said buffers at said rear of said web that is diametrically opposed to said one buffer abut said stops of said intermediate rail and said pull out rail.

13. An assembly as claimed in claim 8, wherein one said cage is longer than the other.

14. An assembly as claimed in claim 13, wherein said one cage is aligned horizontally.

* * * * *